US006008761A

United States Patent [19]

Harano

[11] Patent Number: 6,008,761

[45] Date of Patent: Dec. 28, 1999

[54] LOOP ANTENNA

[75] Inventor: Nobuya Harano, Shizuoka, Japan

[73] Assignee: NEC Corporation, Tokyo, Japan

[21] Appl. No.: 08/877,283

[22] Filed: Jun. 17, 1997

[30] Foreign Application Priority Data

Jun. 17, 1996 [JP] Japan ..... 8-155892

[51] Int. Cl.[6] ..... H01Q 1/24

[52] U.S. Cl. ..... 343/366; 343/702; 343/742

[58] Field of Search ..... 343/702, 718, 343/741, 742, 866; H01Q 1/24

[56] References Cited

U.S. PATENT DOCUMENTS

| | | | |
|---|---|---|---|
| 4,894,663 | 1/1990 | Urbish et al. | 343/702 |
| 5,164,737 | 11/1992 | Murray et al. | 343/702 |
| 5,673,054 | 9/1997 | Hama | 343/702 |

FOREIGN PATENT DOCUMENTS

| | | |
|---|---|---|
| 0 689 301 A1 | 6/1995 | European Pat. Off. . |
| 0 701 297 A1 | 9/1995 | European Pat. Off. . |
| 49-110550 | 9/1974 | Japan . |
| 53-85948 | 7/1978 | Japan . |
| 56-125646 | 9/1981 | Japan . |
| 60-7204 | 1/1985 | Japan . |
| 60-111104 | 7/1985 | Japan . |
| 5-2425 | 1/1993 | Japan . |
| 5-183317 | 7/1993 | Japan . |
| 5-97113 | 12/1993 | Japan . |
| 6-197062 | 7/1994 | Japan . |
| 8-23217 | 1/1996 | Japan . |
| 1060243 | 4/1964 | United Kingdom . |

*Primary Examiner*—Don Wong
*Assistant Examiner*—Hoang Nguyen
*Attorney, Agent, or Firm*—Scully, Scott, Murphy & Presser

[57] ABSTRACT

A loop antenna for a portable, compact radio device, which has a high gain and a high strength according to this invention, is realized such that side surfaces of the loop antenna are inclined or bent along the inclined or curved outer surface portions of a housing.

15 Claims, 3 Drawing Sheets

LOOP ANTENNA

BACKGROUND OF THE INVENTION

1. FIELD OF THE INVENTION

The present invention relates to a loop antenna used for a portable, compact radio device.

2. DESCRIPTION OF THE PRIOR ART

Antennas excellent in portability and free from degradation of antenna gains even upon being carried by users have been used in conventional portable, compact radio devices. Among these antennas, a loop antenna disclosed in, e.g., Japanese Unexamined Utility Model Publication No. 5-2425 is most popular. For example, as shown in FIG. 1, this antenna is obtained by forming a band-like antenna conductor 1 into a loop. The loop antenna is disposed in a plastic housing 2 of a radio device such that the opening of the antenna conductor 1 faces outward. At the same time, the loop antenna is coupled to a parts board 4 of the radio device through a feeder 3. This antenna is excellent in portability because it can be incorporated in the housing 2. When the device is carried by a user, a higher antenna gain than that in a free space can be advantageously obtained due to a human body image effect. The human body image effect implies such phenomenon that an image loop is produced when the radio device is carried by a user, so that current in phase with an actual loop will flow and a peak of electromagnetic intensity will appear in the vicining of a human body by the image antenna in phase with the actual loop.

Since the loop antenna, however, is a magnetic field type antenna, the effective opening surface decreases upon receiving the influence of a metal object located close to the antenna opening. A radiation resistance decreases with respect to the loss resistance of the antenna. As result, in a portable, compact radio device in which an antenna is located very close to a radio unit, the influences of the device board and device parts undesirably lower the antenna gain.

To solve the above problem, the loop antenna must be located at a physically remote position from the radio unit. As the radio unit is, however, basically connected to the loop antenna through only the feeder, the strength of the antenna itself cannot be assured at the physically remote position from the radio unit.

To solve the above problem, it is desirable to arrange the antenna at the inner surface portion of the housing. The physical size of the antenna must be reduced due to the layout of the antenna at the inner surface portion of the housing, higher performance of a recent radio device, and an increase in packing density which result from downsizing. As a result, it becomes difficult to maintain conventional reception characteristics because the reception characteristics can be improved in proportion to an increase in effective size of the antenna. That is, in a conventional loop antenna, downsizing of the antenna is the direct cause for degrading the antenna characteristics.

SUMMARY OF THE INVENTION

The present invention has been made to solve the conventional problems described above, and has as its object to provide a compact loop antenna having a high gain and a high mechanical strength in a portable, compact radio device.

In order to achieve the above object of the present invention, there is provided a band-like loop antenna disposed along an inner surface of a housing of a portable, compact radio device, wherein the loop antenna is bent such that a side surface of the loop antenna which is located on the inner side of the radio device is located at a position outward in a radial direction of a loop of the loop antenna with respect to a side surface of the loop antenna which is located on the outer side of the radio device.

In this case, the side surface of the loop antenna which is located on the inner side of the radio device may be inclined outward in the radial direction of the loop, or the side surface of the loop antenna which is located on the inner side of the radio device may be bent 90° outward in the radial direction of the loop.

The housing can include a support structure engaging with the loop antenna to support the loop antenna in the housing. In addition, the bent portion of the loop antenna is preferably in contact with the inner surface of the housing. In this case, the ridge portion of the housing may be chamfered.

The following effects can be obtainers by the present invention.

1. The band-like loop antenna is partially bent in contact with the housing. For this reason, the strength of the loop antenna can be assured even if the loop antenna must be conventionally mounted in a place where the strength of the antenna cannot be assured. That is, when the antenna is bent in contact with the inner surface of the housing, the contact portion of the antenna with the housing increases to result in an increase in strength.

2. The band-like loop antenna is partially bent outside the opening surface of the loop antenna. For this reason, a small space can be efficiently used to increase the effective area of the opening surface of the antenna. As compared with a conventional loop antenna having no bent portion, the radiation resistance increases without changing the loss resistance, thereby increasing the antenna gain. That is, although the loss resistance does not change due to the unchanged peripheral length of the loop antenna, bending of the antenna results in an apparent increase in effective area of the opening surface of the antenna.

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF PREFERRED EMBODIMENTS

Figure 1:
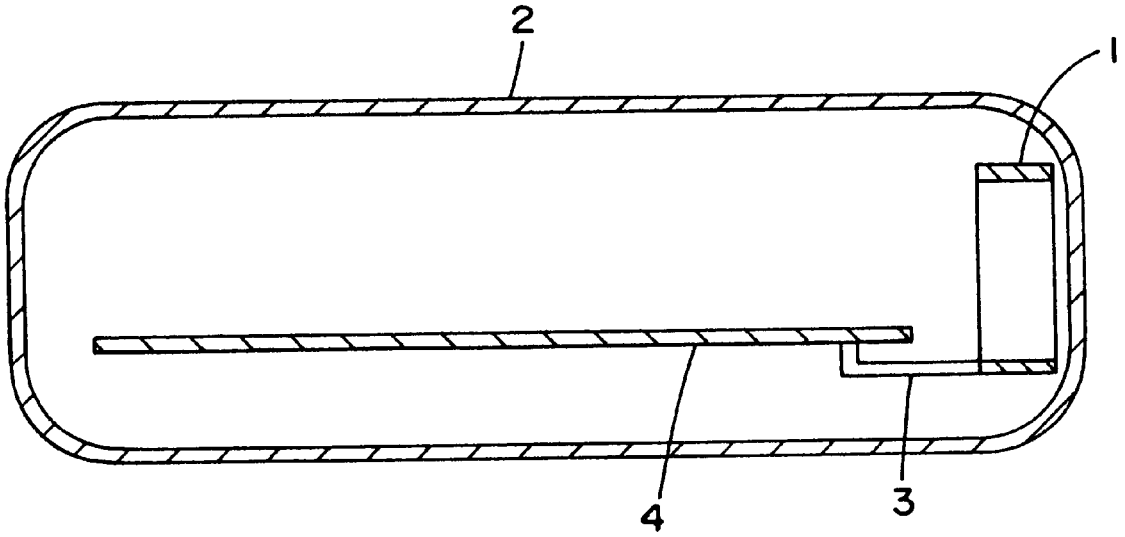
FIG. 1 (PRIOR ART)
FIG. 1 is a sectional view showing the layout of a conventional loop antenna.

Embodiments of the present invention will be described below with reference to the accompanying drawings. The same reference numerals as in FIG. 1 denote the same parts, and a detailed description thereof will be omitted.

Figure 2:
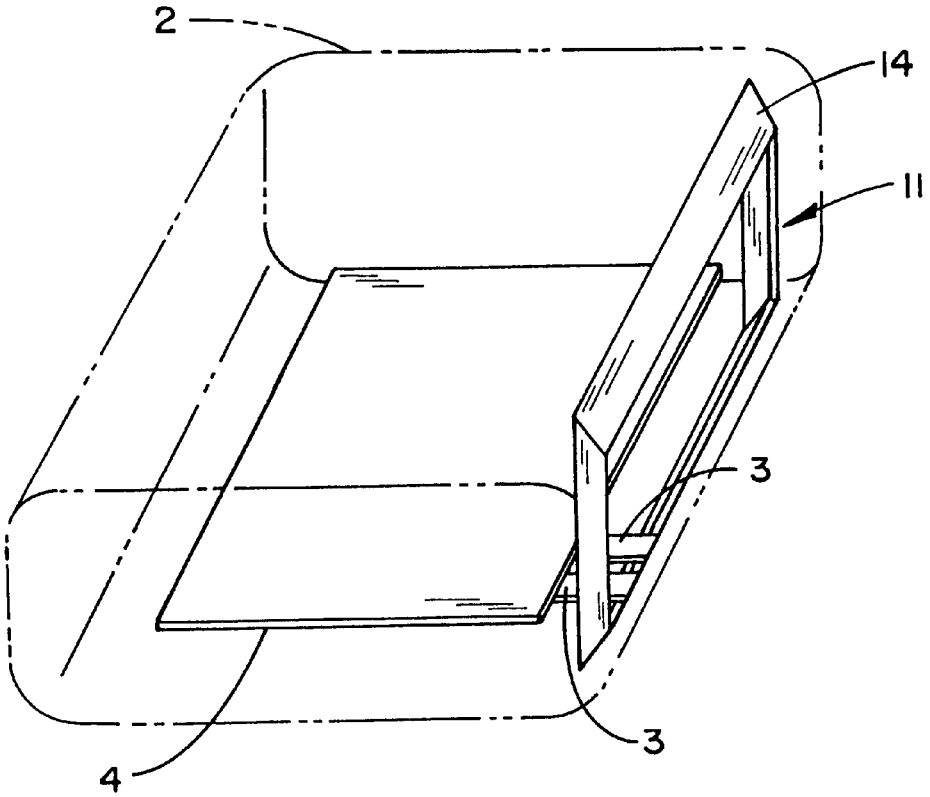
FIG. 2 is a perspective view showing the shape of a loop antenna according to an embodiment of the present invention when viewed from the top.
Figure 3:
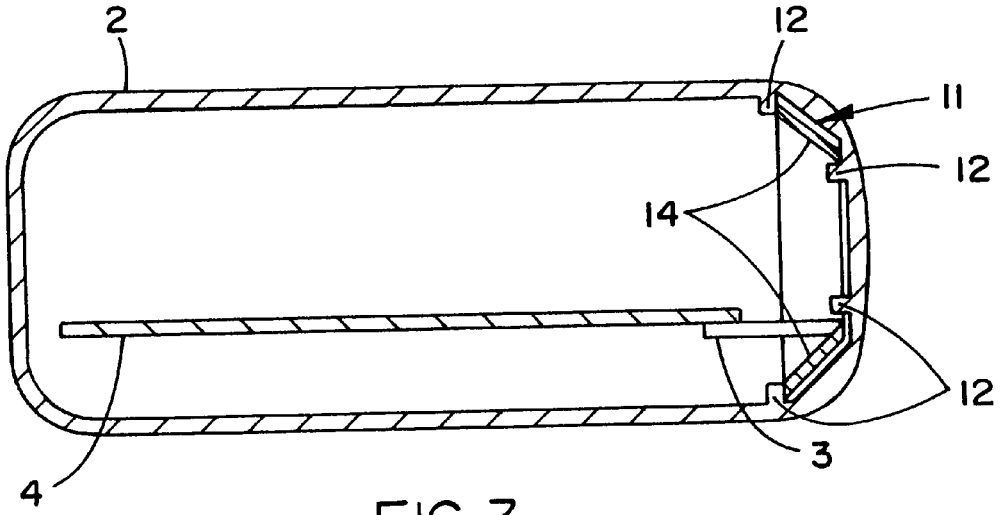
FIG. 3 is a sectional view showing the layout of the loop antenna of the embodiment shown in FIG. 2.

FIGS. 2 and 3 show a structure in which a band-like loop antenna 11 disposed at the inner surface of a housing 2 is partially bent such that side surfaces 14 of the loop antenna 11 which are located on the inner side of a radio device are inclined outward in the radial direction of the loop of the loop antenna 11. The loop antenna 11 is coupled to a parts board 4 through a feeder 3. The loop antenna 11 is inclined such that their side surfaces are bent outward so as not to close its opening surface.

The inclined or curved chamfered portions are formed on the outer surface portions of the housing, and the inner surface portions of the housing 2 are so inclined as to conform to the outer surface portions. As shown in FIG. 3, the bent portions of the loop antenna 11 are brought into contact with the inner surface portions to assure the strength of the loop antenna. In this case, the bent portions of the loop antenna 11 are supported in contact with the inner surface portions such that the end faces of the respective bent portions engage with support structures 12 formed to interpose the inner surface portions in the housing 2.

With the above structure, the number of contacts between the housing 2 and the loop antenna 11 increases to obtain a higher strength. The loop antenna 11 is formed such that the band width of a portion to be bent in band-like loop antenna is set larger than that of the remaining portion and the portion having a larger width is bent in contact with the corresponding inner surface portion of the housing 2. That is, the structure of the present invention can be realized by simply bending part of the conventional band-like loop antenna.

Figure 4:
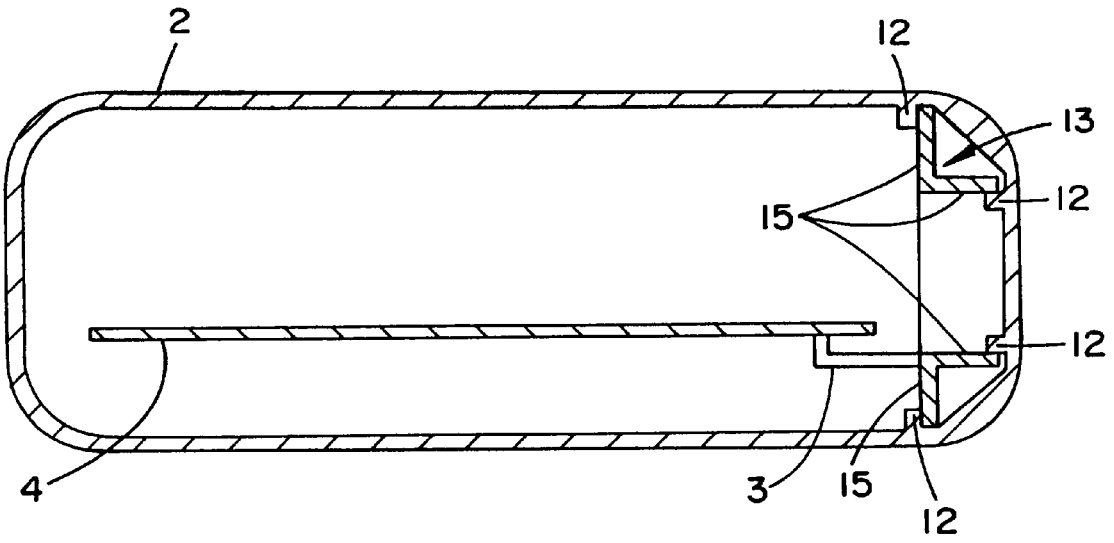
FIG. 4 is a sectional view showing the layout of a loop antenna according to another embodiment of the present invention.

FIG. 4 shows another embodiment of the present invention. In the embodiment shown in FIGS. 2 and 3, each side of the band-like loop antenna 11 is entirely bent outward. However, in the embodiment shown in FIG. 4, a side surface portion of each side of a band-like loop antenna 13, which is located on the inner side of the radio device, is bent 90° outward in the radial direction of the loop, thereby obtaining the same effect as in FIGS. 2 and 3.

The radiation gain of a small loop antenna as in the present invention is determined mainly depending on the radiation efficiency. A radiation efficiency $\eta$ is generally defined as follows:

$\eta$=radiation resistance/radiation resistance+loss resistance

In fact, the radiation efficiency of the small loop antenna is about several %. The loss resistance is large relative to the radiation efficiency, and therefore this antenna is very low in radiation efficiency. To increase the radiation efficiency, the radiation resistance must be increased, and the loss resistance must be suppressed. The loss resistance mainly depends on the conductivity of an antenna conductor, increases in proportion to an increase in peripheral length of the antenna, and decreases in proportion to an increase in conductivity per unit length.

Figure 5:
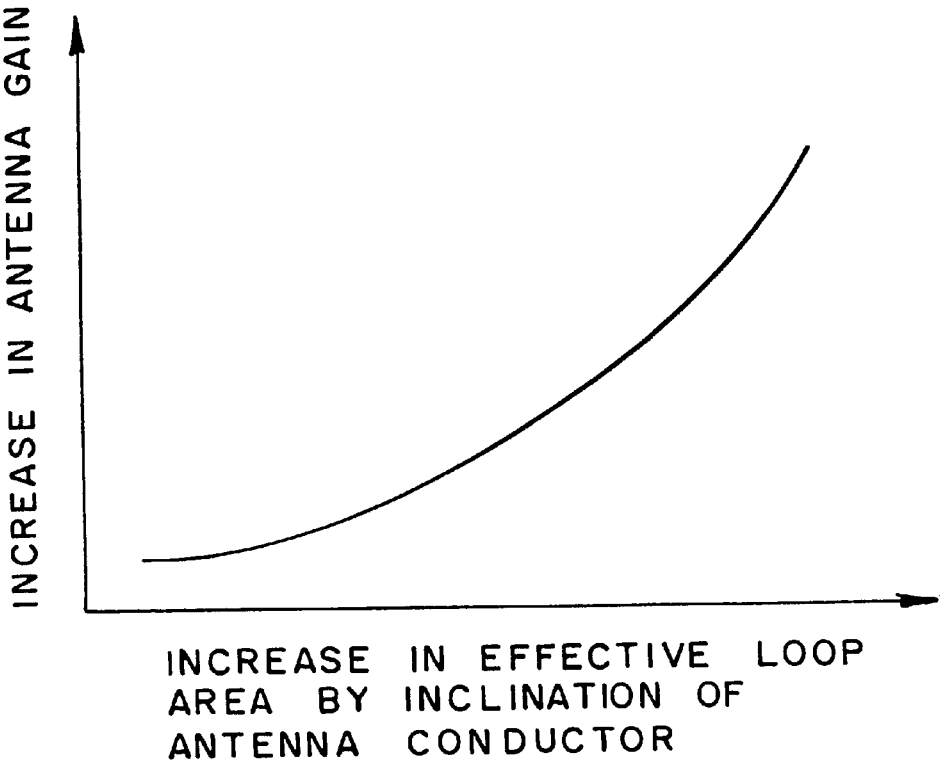
FIG. 5 is a graph showing the relationship between an increase in opening area by inclination of the loop antenna and an increase in antenna gain.

According to the present invention, the peripheral length of the antenna is kept unchanged to suppress the loss resistance. At the same time, the antenna conductor is partially bent outward to result in an apparent increase in effective area of the opening surface of the antenna. The relationship between an increase in opening area by inclination of the loop antenna and an increase in antenna gain is shown in FIG. 5.

What I claim is:

1. A band-like loop antenna disposed along an inner surface of a housing of a portable compact radio device, said loop antenna having a side surface, said side surface being located at a position outward in a radial direction of a loop of said loop antenna and inclined outward in the radial direction of the loop.

2. An antenna according to claim 1, wherein said side surface of said loop antenna is bent 90° outward in the radial direction of the loop.

3. An antenna according to claim 1, wherein said housing includes a support structure engaging with said loop antenna to support said loop antenna in said housing.

4. An antenna according to claim 1, wherein said side surface of said loop antenna is in contact with said inner surface of said housing.

5. An antenna according to claim 4, wherein said housing has a chamfered outer surface portion.

6. A band-like loop antenna disposed along an inner surface of a housing of a portable compact radio device, said loop antenna having a side surface, said side surface being located at a position outward in a radial direction of a loop of said loop antenna and bent 90° outward in the radial direction of the loop.

7. An antenna according to claim 6, wherein said housing includes a support structure engaging with said loop antenna to support said loop antenna in said housing.

8. An antenna a according to claim 6, wherein said side surface of said loop antenna is in contact with said inner surface of said housing.

9. An antenna according to claim 8, wherein said housing has a chamfered outer surface portion.

10. A band-like loop antenna disposed along an inner surface of a housing of a portable compact radio device, said loop antenna having a side surface, said side surface being located at a position outward in a radial direction of a loop of said loop antenna wherein said housing includes a support structure engaging with said loop antenna to support said loop antenna in said housing.

11. An antenna according to claim 10, wherein said side surface of said loop antenna is inclined outward in the radial direction of the loop.

12. An antenna according t0 claim 10, wherein said side surface of said loop antenna is bent 90° outward in the radial direction of the loop.

13. An antenna according to claim 10, wherein said housing includes a support structure engaging with said loop antenna to support said loop antenna in said housing.

14. An antenna according to claim 10, wherein said side surface of said loop antenna is in contact with said inner surface of said housing.

15. An antenna according to claim 14, wherein said housing has a chamfered outer surface portion.

* * * * *